US010010113B2

(12) United States Patent
Zuber et al.

(10) Patent No.: US 10,010,113 B2
(45) Date of Patent: Jul. 3, 2018

(54) AEROSOL-GENERATING SYSTEM FOR GENERATING NICOTINE SALT PARTICLES

(71) Applicant: PHILIP MORRIS PRODUCTS S.A., Neuchatel (CH)

(72) Inventors: Gerard Zuber, Froideville (CH); Marie Farine, Sugiez (CH); Patrick Charles Silvestrini, Neuchatel (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 267 days.

(21) Appl. No.: 15/022,853

(22) PCT Filed: Sep. 19, 2014

(86) PCT No.: PCT/EP2014/070034
§ 371 (c)(1),
(2) Date: Mar. 17, 2016

(87) PCT Pub. No.: WO2015/040180
PCT Pub. Date: Mar. 26, 2015

(65) Prior Publication Data

US 2016/0227839 A1 Aug. 11, 2016

(30) Foreign Application Priority Data

Sep. 19, 2013 (EP) ..... 13185245

(51) Int. Cl.
*A61H 33/12* (2006.01)
*F17C 7/04* (2006.01)
(Continued)

(52) U.S. Cl.
CPC ..... *A24F 47/008* (2013.01); *A24F 47/004* (2013.01); *A24F 47/006* (2013.01); *H05B 3/0014* (2013.01)

(58) Field of Classification Search
None
See application file for complete search history.

(56) References Cited

U.S. PATENT DOCUMENTS 3,258,015 A * 6/1966 Ellis ..... A24F 47/004 131/273
3,356,094 A * 12/1967 Ellis ..... A24F 47/004 131/273
(Continued)

FOREIGN PATENT DOCUMENTS

CN 1190335 A 8/1998
CN 201238610 Y 5/2009
(Continued)

OTHER PUBLICATIONS

International Search Report dated Apr. 22, 2015, in PCT/EP2014/070034 Filed Sep. 19, 2014.
(Continued)

*Primary Examiner* — Thor Campbell
(74) *Attorney, Agent, or Firm* — Oblon, McClelland, Maier & Neustadt, L.L.P.

(57) ABSTRACT

An aerosol-generating system is provided, including a nicotine source; a volatile delivery enhancing compound source downstream of the nicotine source and including an acid; heating means for heating the nicotine source; and a physically separate heat transfer barrier between the nicotine source and the volatile delivery enhancing compound source. The heating means is configured to heat the nicotine source to a temperature of between about 80° C. and about 150° C. The heat transfer barrier is configured so that the temperature of the volatile delivery enhancing compound source is less than about 50° C. when the nicotine source is heated to a temperature of between about 80° C. and about 150° C. by the heating means.

14 Claims, 1 Drawing Sheet

(51) Int. Cl.
*A24F 47/00* (2006.01)
*H05B 3/00* (2006.01)

(56) References Cited

U.S. PATENT DOCUMENTS 4,715,387 A * 12/1987 Rose ..... A61M 15/00 131/270
4,765,348 A * 8/1988 Honeycutt ..... A24F 47/002 131/273
4,776,353 A * 10/1988 Lilja ..... A24B 15/18 131/273
4,830,028 A * 5/1989 Lawson ..... A24B 15/30 131/310
4,924,886 A * 5/1990 Litzinger ..... A24B 15/10 131/194
4,955,397 A * 9/1990 Johnson ..... A24B 15/165 131/194
5,033,483 A * 7/1991 Clearman ..... A24F 47/004 131/194
5,101,838 A * 4/1992 Schwartz ..... A24F 47/002 131/273
5,105,834 A * 4/1992 Saintsing ..... A24B 15/24 131/334
5,133,368 A * 7/1992 Neumann ..... A24B 15/165 131/276
5,327,915 A * 7/1994 Porenski ..... A24F 47/004 131/194
5,538,020 A * 7/1996 Farrier ..... A24B 15/165 131/194
5,593,792 A 1/1997 Farrier et al.
6,102,036 A * 8/2000 Slutsky ..... A61M 15/0045 128/202.21
7,559,325 B2 * 7/2009 Dunkley ..... A61M 15/0028 128/203.21
8,499,766 B1 * 8/2013 Newton ..... A24F 47/002 131/273
9,380,810 B2 * 7/2016 Rose ..... A24F 47/008
9,603,386 B2 * 3/2017 Xiang ..... A24F 47/008
9,675,114 B2 * 6/2017 Timmermans ..... A24F 47/008
9,808,032 B2 * 11/2017 Yamada ..... A24F 47/008
2008/0241255 A1 * 10/2008 Rose ..... A61K 31/4439 424/489
2009/0095287 A1 * 4/2009 Emarlou ..... A61M 11/041 128/200.14
2013/0014755 A1 * 1/2013 Kumar ..... A24F 47/006 128/202.21
2013/0276804 A1 * 10/2013 Hon ..... A24F 47/002 131/329
2013/0284192 A1 * 10/2013 Peleg ..... A24F 47/002 131/329
2013/0319440 A1 * 12/2013 Capuano ..... A24F 47/008 131/329
2013/0340775 A1 * 12/2013 Juster ..... H04L 67/42 131/273
2014/0053856 A1 * 2/2014 Liu ..... A24F 47/008 131/329
2014/0107815 A1 * 4/2014 Lamothe ..... A24F 15/18 700/90
2014/0123990 A1 * 5/2014 Timmermans ..... A24F 47/008 131/328
2014/0174459 A1 * 6/2014 Burstyn ..... A24F 47/008 131/273
2017/0340017 A1 * 11/2017 Thorens ..... A24F 47/008

FOREIGN PATENT DOCUMENTS

CN 101778578 A 7/2010
CN 102014995 A 4/2011
DE 10 2011 111 999 A1 2/2013
EP 0 520 231 A2 12/1992
WO 2008 121610 A1 10/2008
WO WO 2010/107613 A1 9/2010
WO WO 2011/034723 A1 3/2011
WO WO 2013/030202 A1 3/2013
WO WO 2014/140087 A1 9/2014
WO WO 2014/140320 A1 9/2014

OTHER PUBLICATIONS

Chinese Office Action and Search Report with English translation dated Mar. 26, 2018 in corresponding Chinese Patent Application No. 201480047226.5, citing documents AO-AS therein (11 pages).

* cited by examiner

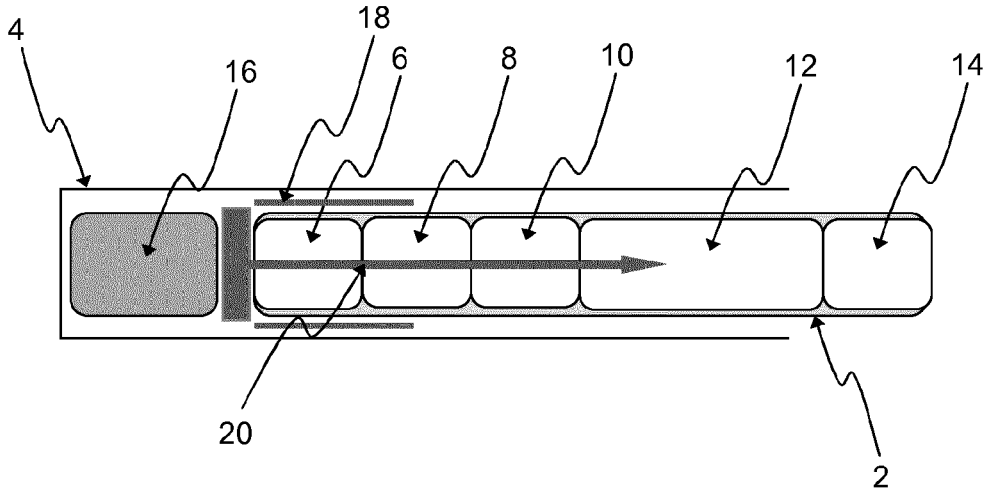
4
16
18
6
8
10
12
14
20
2

AEROSOL-GENERATING SYSTEM FOR GENERATING NICOTINE SALT PARTICLES

The present invention relates to an aerosol-generating system. In particular, the present invention relates to an aerosol-generating system for generating an aerosol comprising nicotine salt particles.

Devices for delivering nicotine to a user comprising a nicotine source and a volatile delivery enhancing compound source are known. For instance, WO 2008/121610 A1 discloses a device in which nicotine and a volatile delivery enhancing compound are reacted with one another in the gas phase to form an aerosol of nicotine salt particles that is inhaled by the user. However, WO 2008/121610 A1 does not address how to optimize the ratio of nicotine and volatile delivery enhancing compound in the gas phase to minimize the amount of unreacted nicotine vapour and delivery enhancing compound vapour delivered to a user.

For example, where the vapour pressure of the volatile delivery enhancing compound is different from the vapour pressure of nicotine, this can lead to a difference in the vapour concentration of the two reactants. Differences between the vapour concentration of the volatile delivery enhancing compound and nicotine can lead to the delivery of unreacted delivery enhancing compound vapour to a user.

It is desirable to produce a maximum quantity of nicotine salt particles for delivery to a user using a minimum quantity of reactants. Consequently, it would be desirable to provide an aerosol-generating system of the type disclosed in WO 2008/121610 A1 that further improves the formation of an aerosol of nicotine salt particles for delivery to a user. It is especially desirable to increase the proportion of the gas phase volatile delivery enhancing compound that is reacted with the gas phase nicotine.

According to the invention there are provided aerosol-generating systems comprising: a nicotine source; a volatile delivery enhancing compound source downstream of the nicotine source, wherein the volatile delivery enhancing compound comprises an acid; heating means configured to heat the nicotine source; and a physically separate heat transfer barrier between the nicotine source and the volatile delivery enhancing compound source.

According to the invention there is provided an aerosol-generating system comprising: a nicotine source; a volatile delivery enhancing compound source downstream of the nicotine source, wherein the volatile delivery enhancing compound comprises an acid; heating means configured to heat the nicotine source to a temperature of between about 80° C. and about 150° C.; and a physically separate heat transfer barrier between the nicotine source and the volatile delivery enhancing compound source, wherein the heat transfer barrier is configured so that in use the temperature of the volatile delivery enhancing compound source is below about 60° C. when the nicotine source is heated to a temperature of between about 80° C. and about 150° C. by the heating means.

In certain embodiments, the heat transfer barrier comprises a solid material having a thermal conductivity of less than about 1 W per meter Kelvin (W/(m·K)) at 23° C. and a relative humidity of 50%.

In other embodiments, the heat transfer barrier comprises a cavity having a length of at least about 8 mm.

The aerosol-generating system comprises a proximal end through which, in use, an aerosol exits the aerosol-generating system for delivery to a user. The proximal end may also be referred to as the mouth end. In use, a user draws on the proximal end of the aerosol-generating article in order to inhale an aerosol generated by the aerosol-generating system. The aerosol-generating system comprises a distal end opposed to the proximal end.

As used herein, the term "longitudinal" is used to describe the direction between the proximal end and the opposed distal end of the aerosol-generating system and the term "transverse" is used to describe the direction perpendicular to the longitudinal direction.

As used herein, by "length" is meant the maximum longitudinal dimension between the distal end and the proximal end of components, or portions of components, of aerosol-generating systems according to the invention.

As used herein, the terms "upstream" and "downstream" are used to describe the relative positions of components, or portions of components, of aerosol-generating systems according to the invention with respect to the direction of airflow through the aerosol-generating system when a user draws on the proximal end of the aerosol-generating system.

When a user draws on the proximal end of the aerosol-generating system, air is drawn into the aerosol-generating system, passes downstream through the aerosol-generating system and exits the aerosol-generating system at the proximal end.

The proximal end of the aerosol-generating system may also be referred to as the downstream end and components, or portions of components, of the aerosol-generating system may be described as being upstream or downstream of one another based on their positions relative to the airflow through the aerosol-generating system towards the proximal end.

Location of the volatile delivery enhancing compound source downstream of the nicotine source advantageously improves the consistency of the nicotine delivery of aerosol-generating systems according to the invention.

Without being bound by theory, it is believed that location of the volatile delivery enhancing compound source downstream of the nicotine source in aerosol-generating systems according to the invention reduces or prevents deposition of volatile delivery enhancing compound vapour released from the volatile delivery enhancing compound source on the nicotine source during use. This reduces fading over time of the nicotine delivery in aerosol-generating systems according to the invention.

The heat transfer barrier separates the nicotine source and the volatile delivery enhancing compound source. The heat transfer barrier is configured to reduce heat transfer between the nicotine source and the volatile delivery enhancing compound source.

Inclusion of a heat transfer barrier between the nicotine source and the volatile delivery enhancing compound source advantageously enables the volatile delivery enhancing compound source of aerosol-generating systems according to the invention to be maintained at a lower temperature while the nicotine source is heated to a higher temperature by the heating means. In particular, inclusion of a heat transfer barrier advantageously enables the nicotine delivery of aerosol-generating systems according to the invention to be significantly increased by increasing the temperature of the nicotine source while the volatile delivery enhancing compound source is maintained at a temperature below the thermal decomposition temperature of the volatile delivery enhancing compound.

As used herein, "heat transfer barrier" is used to describe a physical barrier that reduces the amount of heat transferred from the nicotine source to the volatile delivery enhancing compound source compared to an aerosol-generating system in which no barrier is present. The physical barrier may comprise a solid material. Alternatively or in addition, the physical barrier may comprise a gas, vacuum or partial vacuum between the nicotine source and the volatile delivery enhancing compound source.

The heat transfer barrier is physically separate from the nicotine source and the volatile delivery enhancing compound source. As used herein, by "physically separate" it is meant the heat transfer barrier does not form part of the nicotine source or the volatile delivery enhancing compound source. That is, aerosol-generating systems according to the invention comprise a heat transfer barrier in addition to a nicotine source and a volatile delivery enhancing compound source.

Preferably, the heating means is configured to heat the nicotine source to a temperature of between about 80° C. and about 150° C. More preferably, the heating means is configured to heat the nicotine source to a temperature of between about 100° C. and about 120° C. In certain embodiments, the heating means is configured to heat the nicotine source to a temperature of about 110° C.

The heating means may comprise any heater capable of heating the nicotine source to a temperature of between about 80° C. and about 150° C.

Differential heating of the nicotine source and the volatile delivery enhancing compound source advantageously enables the vapour concentrations of the nicotine and the volatile delivery enhancing compound to be controlled and balanced proportionally to yield an efficient reaction stoichiometry. This advantageously improves the efficiency of the formation of an aerosol and the consistency of nicotine delivery to a user.

In combination, location of the volatile delivery enhancing compound source downstream of the nicotine source and inclusion of a heat transfer barrier between the nicotine source and the volatile delivery enhancing compound source thereby advantageously reduces variability in the nicotine delivery of aerosol-generating systems according to the invention. In particular, in combination, location of the volatile delivery enhancing compound source downstream of the nicotine source and inclusion of a heat transfer barrier between the nicotine source and the volatile delivery enhancing compound source advantageously enables the molar ratio of nicotine vapour to volatile delivery enhancing compound vapour to be kept substantially constant during use of aerosol-generating systems according to the invention.

By enabling the molar ratio of nicotine vapour to volatile delivery enhancing compound vapour to be kept substantially constant during use, location of the volatile delivery enhancing compound source downstream of the nicotine source and inclusion of a heat transfer barrier between the nicotine source and the volatile delivery enhancing compound source also advantageously enables delivery of unreacted delivery enhancing compound vapour to a user to be reduced without inclusion of a specialised filter or other volatile delivery enhancing compound removal means downstream of the volatile delivery enhancing compound source.

The constructions, dimensions and physical properties of the heat transfer barrier may be selected to achieve a sufficient reduction in heat transfer between the nicotine source and the volatile delivery enhancing compound source to maintain the volatile delivery enhancing compound source below a desired temperature.

Preferably, the heat transfer barrier is configured so that in use the volatile delivery enhancing compound source is maintained at a temperature of less than about 60° C. More preferably, the heat transfer barrier is configured so that in use the volatile delivery enhancing compound source is maintained at a temperature of less than about 50° C. In certain embodiments, the heating means is configured so that in use the volatile delivery enhancing compound source is maintained at a temperature of less than or equal to about 45° C.

The heat transfer barrier may be formed from a thermally insulating material.

In certain embodiments, the heat transfer barrier comprises a solid material having a thermal conductivity of less than about 1 W per meter Kelvin (W/(m·K)) at 23° C. and a relative humidity of 50%. Preferably the heat transfer element comprises a solid material having a thermal conductivity of less than about 5 W per meter Kelvin (W/(m·K)) at 23° C. and a relative humidity of 50% as measured using the modified transient plane source (MTPS) method. More preferably, the heat transfer element comprises a solid material having a thermal conductivity of less than about 1 W per meter Kelvin (W/(m·K)) at 23° C. and a relative humidity of 50% as measured using the modified transient plane source (MTPS) method. In certain embodiments, the heat transfer element comprises a solid material having a thermal conductivity of less than about 0.1 W per meter Kelvin (W/(m·K)) at 23° C. and a relative humidity of 50% as measured using the modified transient plane source (MTPS) method.

The heat transfer barrier may comprise any suitable thermally insulating material. Preferably the thermally insulating material is a food-safe material. Suitable thermally insulating materials include, but are not limited to, plastic materials, such as polyurethane, polyethylene (PE), polyethylene terephthalate (PET), polytetrafluoroethylene (PTFE), glass, paper, cardboard and cellulose fibre. Those skilled in the art will be aware of other suitable thermally insulating materials.

In other embodiments, the heat transfer barrier may comprise a cavity.

As used herein with reference to the heat transfer barrier, the term "cavity" is used to describe a gas-filled space or compartment or a space or compartment comprising a region of reduced air pressure, such as a vacuum or partial vacuum. Preferably, the cavity is a gas-filled space. More preferably, the cavity is an air-filled space.

In such embodiments, preferably the heat transfer barrier comprises a cavity having a length of at least about 8 mm. More preferably, the heat transfer barrier comprises a cavity having a length of at least about 9 mm. In certain embodiments, the heat transfer barrier comprises a cavity having a length of at least about 10 mm.

Aerosol-generating systems according to the invention comprise a volatile delivery enhancing compound source. The volatile delivery enhancing compound comprises an acid. As used herein, by "volatile" it is meant the delivery enhancing compound has a vapour pressure of at least about 20 Pa. Unless otherwise stated, all vapour pressures referred to herein are vapour pressures at 25° C. measured in accordance with ASTM E1194-07.

Preferably, the volatile delivery enhancing compound has a vapour pressure of at least about 50 Pa, more preferably at least about 75 Pa, most preferably at least 100 Pa at 25° C.

Preferably, the volatile delivery enhancing compound has a vapour pressure of less than or equal to about 400 Pa, more preferably less than or equal to about 300 Pa, even more preferably less than or equal to about 275 Pa, most preferably less than or equal to about 250 Pa at 25° C.

In certain embodiments, the volatile delivery enhancing compound may have a vapour pressure of between about 20 Pa and about 400 Pa, more preferably between about 20 Pa and about 300 Pa, even more preferably between about 20 Pa and about 275 Pa, most preferably between about 20 Pa and about 250 Pa at 25° C.

In other embodiments, the volatile delivery enhancing compound may have a vapour pressure of between about 50 Pa and about 400 Pa, more preferably between about 50 Pa and about 300 Pa, even more preferably between about 50 Pa and about 275 Pa, most preferably between about 50 Pa and about 250 Pa at 25° C.

In further embodiments, the volatile delivery enhancing compound may have a vapour pressure of between about 75 Pa and about 400 Pa, more preferably between about 75 Pa and about 300 Pa, even more preferably between about 75 Pa and about 275 Pa, most preferably between about 75 Pa and about 250 Pa at 25° C.

In yet further embodiments, the volatile delivery enhancing compound may have a vapour pressure of between about 100 Pa and about 400 Pa, more preferably between about 100 Pa and about 300 Pa, even more preferably between about 100 Pa and about 275 Pa, most preferably between about 100 Pa and about 250 Pa at 25° C.

The volatile delivery enhancing compound may comprise a single compound. Alternatively, the volatile delivery enhancing compound may comprise two or more different compounds.

Where the volatile delivery enhancing compound comprises two or more different compounds, the two or more different compounds in combination have a vapour pressure of at least about 20 Pa at 25° C.

Preferably, the volatile delivery enhancing compound is a volatile liquid.

The volatile delivery enhancing compound may comprise a mixture of two or more different liquid compounds.

The volatile delivery enhancing compound may comprise an aqueous solution of one or more compounds. Alternatively the volatile delivery enhancing compound may comprise a non-aqueous solution of one or more compounds.

The volatile delivery enhancing compound may comprise two or more different volatile compounds. For example, the volatile delivery enhancing compound may comprise a mixture of two or more different volatile liquid compounds.

Alternatively, the volatile delivery enhancing compound may comprise one or more non-volatile compounds and one or more volatile compounds. For example, the volatile delivery enhancing compound may comprise a solution of one or more non-volatile compounds in a volatile solvent or a mixture of one or more non-volatile liquid compounds and one or more volatile liquid compounds.

The volatile delivery enhancing compound comprises an acid. The volatile delivery enhancing compound may comprise an organic acid or an inorganic acid. Preferably, the volatile delivery enhancing compound comprises an organic acid, more preferably a carboxylic acid. In certain particularly preferred embodiments, the volatile delivery enhancing compound comprises a 2-oxo acid. In other particularly preferred embodiments, the volatile delivery enhancing compound comprises an alpha hydroxy acid.

Examples of suitable carboxylic acids include those selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. In particularly preferred embodiments, the volatile delivery enhancing compound comprises pyruvic acid or lactic acid.

In preferred embodiments, the volatile delivery enhancing compound source comprises a sorption element and a volatile delivery enhancing compound sorbed on the sorption element.

As used herein, by "sorbed" it is meant that the volatile delivery enhancing compound is adsorbed on the surface of the sorption element, or absorbed in the sorption element, or both adsorbed on and absorbed in the sorption element. Preferably, the volatile delivery enhancing compound is adsorbed on the sorption element.

The sorption element may be formed from any suitable material or combination of materials. For example, the sorption element may comprise one or more of glass, stainless steel, aluminium, polyethylene (PE), polypropylene, polyethylene terephthalate (PET), polybutylene terephthalate (PBT), polytetrafluoroethylene (PTFE), expanded polytetrafluoroethylene (ePTFE), and combinations thereof. For example, the sorption element may comprise both PE and PET.

In preferred embodiments, the sorption element is a porous sorption element.

For example, the sorption element may be a porous sorption element comprising one or more materials selected from the group consisting of porous plastic materials, porous polymer fibres and porous glass fibres.

The sorption element is preferably chemically inert with respect to the volatile delivery enhancing compound.

The sorption element may have any suitable size and shape.

In certain preferred embodiments, the sorption element is a substantially cylindrical plug. In certain particularly preferred embodiments, the sorption element is a porous substantially cylindrical plug.

In other preferred embodiments, the sorption element is a substantially cylindrical hollow tube. In other particularly preferred embodiments, the sorption element is a porous substantially cylindrical hollow tube.

The size, shape and composition of the sorption element may be chosen to allow a desired amount of volatile delivery enhancing compound to be sorbed on the sorption element.

The volatile delivery enhancing compound source should comprise sufficient volatile delivery enhancing compound to generate a desired quantity of aerosol for delivery to a user.

The sorption element advantageously acts as a reservoir for the volatile delivery enhancing compound.

Aerosol-generating systems according to the invention also comprise a nicotine source. Nicotine has a vapour pressure of between about 5 Pa and about 6 Pa at 25° C.

The nicotine source may comprise one or more of nicotine, nicotine base, a nicotine salt, such as nicotine-HCl, nicotine-bitartrate, or nicotine-ditartrate, or a nicotine derivative.

The nicotine source may comprise natural nicotine or synthetic nicotine.

The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof.

For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulfate and combinations thereof.

In certain embodiments, the nicotine source may comprise an aqueous solution of nicotine, nicotine base, a nicotine salt or a nicotine derivative and an electrolyte forming compound.

Alternatively or in addition, the nicotine source may further comprise other components including, but not limited to, natural flavours, artificial flavours and antioxidants.

The nicotine source may comprise a sorption element and nicotine sorbed on the sorption element.

As used herein, by "sorbed" it is meant that the nicotine is adsorbed on the surface of the sorption element, or absorbed in the sorption element, or both adsorbed on and absorbed in the sorption element.

The sorption element may be formed from any suitable material or combination of materials. For example, the sorption element may comprise one or more of glass, stainless steel, aluminium, polyethylene (PE), polypropylene, polyethylene terephthalate (PET), polybutylene terephthalate (PBT), polytetrafluoroethylene (PTFE), expanded polytetrafluoroethylene (ePTFE), and mixtures thereof. For instance, the sorption element may comprise a mixture of PE and PET.

In preferred embodiments, the sorption element is a porous sorption element.

For example, the sorption element may be a porous sorption element comprising one or more materials selected from the group consisting of porous plastic materials, porous polymer fibres and porous glass fibres.

The sorption element is preferably chemically inert with respect to the nicotine.

The sorption element may have any suitable size and shape.

In certain preferred embodiments, the sorption element is a substantially cylindrical plug. In certain particularly preferred embodiments, the sorption element is a porous substantially cylindrical plug.

In other preferred embodiments, the sorption element is a substantially cylindrical hollow tube. In other particularly preferred embodiments, the sorption element is a porous substantially cylindrical hollow tube.

The size, shape and composition of the sorption element may be chosen to allow a desired amount of nicotine to be sorbed on the sorption element. Those skilled in the art will be able to design a suitable sorption element according to the desired function thereof.

The nicotine source should comprise sufficient nicotine to generate a desired quantity of aerosol for delivery to a user.

The sorption element advantageously acts as a reservoir for the nicotine.

It will be appreciated that the nicotine source and the delivery enhancing compound source may comprise sorption elements having the same or different composition.

It will be appreciated that the nicotine source and the delivery enhancing compound source may comprise sorption elements of the same or different size and shape.

Aerosol-generating systems according to the invention may comprise a first compartment comprising the nicotine source and a second compartment comprising the volatile delivery enhancing compound source.

In such embodiments, the aerosol-generating system may further comprise a third compartment downstream of the second compartment.

Alternatively or in addition, in such embodiments, the aerosol-generating system may further comprise a mouthpiece downstream of the second compartment and the third compartment, where included.

In certain preferred embodiments, aerosol-generating systems according to the invention may comprise a housing comprising an air inlet and an air outlet, the housing comprising in series from air inlet to air outlet: a first compartment comprising the nicotine source in communication with the air inlet; a second compartment comprising the volatile delivery enhancing compound source in communication with the first compartment; and a heat transfer barrier between the first compartment and the second compartment, wherein the air inlet and the air outlet are in communication with each other and configured so that air may pass into the housing through the air inlet, through the housing and out of the housing through the air outlet.

As used herein, the term "air inlet" is used to describe one or more apertures through which air may be drawn into the housing.

As used herein, the term "air outlet" is used to describe one or more apertures through which air may be drawn out of the housing.

The air outlet is located at the proximal end of the housing of the aerosol-generating system. The air inlet may be located at the distal end of the housing of the aerosol-generating system. Alternatively, the air inlet may be located between the proximal end and the distal end of the housing of the aerosol-generating system.

As used herein, by "series" it is meant that the first compartment and the second compartment are arranged within the housing so that in use air passing into the housing through the air inlet, through the housing and out of the housing through the air outlet first passes the first compartment and then passes the second compartment. That is, the first compartment is downstream of the air inlet, the second compartment is downstream of the first compartment and the air outlet is downstream of the second compartment.

Nicotine vapour is released from the nicotine source in the first compartment into the air as it passes downstream through the housing from the air inlet towards the air outlet. Volatile delivery enhancing compound vapour is also released from the volatile delivery enhancing compound source in the second compartment into the air as it passes further downstream through the housing from the first compartment towards the air outlet. The nicotine vapour reacts with the volatile delivery enhancing compound vapour in the gas phase to form an aerosol, which is delivered to a user through the air outlet.

In such preferred embodiments, the housing may further comprise a third compartment downstream of and in communication with the second compartment.

Alternatively or in addition, in such preferred embodiments, the housing may further comprise a mouthpiece in communication with: the second compartment or the third compartment, where included.

The nicotine vapour may react with the volatile delivery enhancing compound vapour in the second compartment to form an aerosol. Where aerosol-generating systems according to the invention further comprise a third compartment downstream of the second compartment, the nicotine vapour may alternatively or in addition react with the volatile delivery enhancing compound vapour in the third compartment to form an aerosol.

The volume of the first compartment and the second compartment may be the same or different. Where aerosol-generating systems according to the invention further comprise a third compartment downstream of the second compartment, the volume of the first compartment, the second compartment and the third compartment may be the same or different.

In certain preferred embodiments, the volume of the first compartment and the second compartment are substantially the same.

In certain embodiments, the volume of the first compartment, the second compartment and the heat transfer barrier are substantially the same.

In one embodiment, the first compartment, the second compartment and the heat transfer barrier are each about 10 mm in length.

Where aerosol-generating systems according to the invention comprise a first compartment comprising the nicotine source, the first compartment may be sealed by one or more frangible barriers prior to first use of the aerosol-generating system. In certain preferred embodiments, the first compartment is sealed by a pair of opposed transverse frangible barriers.

Alternatively or in addition, where aerosol-generating systems according to the invention comprise a second compartment comprising the volatile delivery enhancing compound source, the second compartment may be sealed by one or more frangible barriers prior to first use of the aerosol-generating system. In certain preferred embodiments, the second compartment is sealed by a pair of opposed transverse frangible barriers.

The one or more frangible barriers may be formed from any suitable material. For example, the one or more frangible barriers may be formed from a metal foil or film.

In such embodiments, aerosol-generating systems according to the invention preferably further comprises a piercing element for piercing the one or more frangible barriers sealing one or both of the first compartment and the second compartment prior to first use of the aerosol-generating system. The piercing element may be formed from any suitable material.

Where aerosol-generating systems according to the invention comprise a third compartment, the third compartment may comprise one or more aerosol-modifying agents. For example, the third compartment may comprise one or more sorbents, such as activated carbon, one or more flavourants, such as menthol, or a combination thereof.

Where aerosol-generating systems according to the invention comprise a mouthpiece, the mouthpiece may comprise a filter. The filter may have a low particulate filtration efficiency or very low particulate filtration efficiency. Alternatively, the mouthpiece may comprise a hollow tube.

The heating means of aerosol-generating systems according to the invention may comprise an external heater.

As used herein, the term "external heater" refers to a heater that in use is positioned externally to the nicotine source of the aerosol-generating system.

Alternatively or in addition, the heating means of aerosol-generating systems according to the invention may comprise an internal heater.

As used herein, the term "internal heater" refers to a heater that in use is positioned internally to the nicotine source of the aerosol-generating system.

The heating means may be an electric heating means.

Where the heating means is an electric heating means, the aerosol-generating system may further comprise an electric power supply. Alternatively, the electric heating means may be powered by an external electric power supply.

Where the heating means is an electric heating means, the aerosol-generating system may also further comprise electronic circuitry configured to control the supply of electric power from the electric power supply to the electric heating means. Any suitable electronic circuitry may be used in order to control the supply of power to the electric heating means. The electronic circuitry may be programmable.

The electric power supply may be a DC voltage source. In preferred embodiments, the electric power supply is a battery. For example, the electric power supply may be a Nickel-metal hydride battery, a Nickel cadmium battery, or a Lithium based battery, for example a Lithium-Cobalt, a Lithium-Iron-Phosphate or a Lithium-Polymer battery. The electric power supply may alternatively be another form of electric charge storage device such as a capacitor. The electric power supply may be rechargeable.

Alternatively, the heating means may be powered by a non-electric power supply, such as a combustible fuel. For example, the heating means may comprise a thermally conductive element that is heated by combustion of a gaseous fuel.

Alternatively, the heating means may be a non-electric heating means, such as a chemical heating means.

In certain embodiments the heating means may comprise a heat sink or heat exchanger configured to transfer thermal energy from an external heat source to the nicotine source. The heat sink or heat exchanger may be formed of any suitable thermally conductive material. Suitable materials include, but are not limited to, metals, such as aluminium and copper.

In certain preferred embodiments, aerosol-generating systems according to the invention may comprise an aerosol-generating article comprising the nicotine source, the volatile delivery enhancing compound source and the heat transfer barrier.

In such embodiments, aerosol-generating systems according to the invention may further comprise an aerosol-generating device in cooperation with the aerosol-generating article, the aerosol generating device comprising the heating means configured to heat the nicotine source of the aerosol-generating article.

As used herein, the term "aerosol-generating article" refers to an article comprising a nicotine source and a delivery enhancing compound source capable of releasing nicotine and a volatile delivery enhancing compound that can react with one another in the gas phase to form an aerosol.

As used herein, the term "aerosol-generating device" refers to a device that interacts with an aerosol-generating article to generate an aerosol that is directly inhalable into a user's lungs thorough the user's mouth.

According to the invention there is also provided an aerosol-generating article for use in an aerosol-generating system according to the invention. According to the invention there is also provided an aerosol-generating device for use in an aerosol-generating system according to the invention.

Preferably, the aerosol-generating article is substantially cylindrical.

The aerosol-generating article may have a transverse cross-section of any suitable shape.

The aerosol-generating device may comprise a cavity configured to receive the aerosol-generating article.

In such embodiments, the cavity of the aerosol-generating device is configured to receive at least the nicotine source of the aerosol-generating article. Preferably, the cavity of the aerosol-generating device is configured to receive the nicotine source, the volatile delivery enhancing compound source and the heat transfer barrier of the aerosol-generating article.

The heating means of the aerosol-generating device may comprise an external heater positioned about a perimeter of the cavity.

Alternatively, the heating means of the aerosol-generating device may comprise an internal heater positioned within the cavity.

The heating means of the aerosol-generating device may comprise one or more heating elements. The one or more heating elements may extend partially along the length of the cavity of the aerosol-generating device. The one or more heating elements may extend fully or partially around the circumference of the cavity of the aerosol-generating device.

In a particularly preferred embodiment, the heating means of the aerosol-generating device comprises one or more heating elements comprising an electrically resistive material.

In certain particularly preferred embodiments, aerosol-generating systems according to the invention may comprise an aerosol-generating article comprising a first compartment comprising the nicotine source, a second compartment comprising the volatile delivery enhancing compound source and a heat transfer barrier between the first compartment and the second compartment.

As described above, the aerosol-generating article may comprise one or more frangible barriers sealing one or both of the first compartment and the second compartment.

In such embodiments, the aerosol-generating device may comprise a piercing element positioned within the cavity of the aerosol-generating device for piercing the one or more frangible barriers sealing one or both of the first compartment and the second compartment of the aerosol-generating article. The piercing member is preferably positioned centrally within the cavity of the aerosol-generating device, along the longitudinal axis of the cavity.

In certain embodiments, the aerosol-generating article may comprise a sealed second compartment comprising a volatile delivery enhancing compound source comprising a tubular porous sorption element and a volatile delivery enhancing compound sorbed on the sorption element and the aerosol-generating device may comprise an elongate piercing element of the type disclosed in WO 2014/140087 A1 comprising a piercing portion adjacent a distal end of the elongate piercing element, a shaft portion, and an obstructing portion adjacent a proximal end of the elongate piercing element. In such embodiments, the piercing portion of the elongate piercing element has a maximum diameter greater than the diameter of the shaft portion of the elongate piercing element, and the obstructing portion of the elongate piercing element has an outer diameter such that it fits within the tubular porous sorption element of the aerosol-generating article when the aerosol-generating article is received in the aerosol-generating device.

In other embodiments, the aerosol-generating device may comprise an elongate piercing element comprising a piercing head at a distal end of the elongate piercing element and a hollow shaft portion comprising at least two apertures wherein, when the aerosol-generating article is received in the aerosol-generating device and the elongate piercing element pierces the one or more frangible barriers sealing one or both of the first compartment and the second compartment of the aerosol-generating article, at least one aperture of the hollow shaft portion of the elongate piercing element is in fluid communication with the first compartment or the second compartment of the aerosol-generating article. In such embodiments, the elongate piercing element has dual functionality: piercing and providing an airflow channel. In certain embodiments, the hollow shaft portion of the elongate piercing element may comprise a first aperture in fluid communication with the first compartment of the aerosol-generating article and a second aperture in fluid communication with the second compartment of the aerosol-generating article.

Preferably, the cavity of the aerosol-generating device is substantially cylindrical.

The cavity of the aerosol-generating device may have a transverse cross-section of any suitable shape. For example, the cavity may be of substantially circular, elliptical, triangular, square, rhomboidal, trapezoidal, pentagonal, hexagonal or octagonal transverse cross-section.

In certain preferred embodiments, the cavity of the aerosol-generating device has a transverse cross-section of substantially the same shape as the transverse cross-section of the aerosol-generating article.

In certain particularly preferred embodiments, the cavity of the aerosol-generating device has a transverse cross-section of substantially the same shape and dimensions as the transverse cross-section of the aerosol-generating article.

Preferably, the aerosol-generating article and the cavity of the aerosol-generating device are of substantially circular transverse cross-section or of substantially elliptical transverse cross-section. Most preferably, the aerosol-generating article and the cavity of the aerosol-generating device are of substantially circular transverse cross-section.

Preferably, the length of the cavity of the aerosol-generating device is less than the length of the aerosol-generating article so that when the aerosol-generating article is received in the cavity of the aerosol-generating device the proximal or downstream end of the aerosol-generating article projects from the cavity of the aerosol-generating device.

Preferably, the cavity of the aerosol-generating device has a diameter substantially equal to or slightly greater than the diameter of the aerosol-generating article.

As used herein, by "diameter" is meant the maximum transverse dimension of the aerosol-generating article and the cavity of the aerosol-generating device.

Aerosol-generating systems according to the invention may simulate a smoking article, such as a cigarette, a cigar, a cigarillo or a pipe, or a cigarette pack. In certain preferred embodiments, aerosol-generating systems according to the invention simulate a cigarette.

Where aerosol-generating systems according to the invention comprise an aerosol-generating article, the aerosol-generating article may simulate a smoking article, such as a cigarette, a cigar, a cigarillo or a pipe, or a cigarette pack. In certain preferred embodiments, the aerosol-generating article may simulate a cigarette.

For the avoidance of doubt, features described above in relation to one aspect of the invention may also be applicable to other aspects of the invention. In particular, features described above in relation to the first aspect of the invention may also relate, where appropriate, to one or both of the second aspect of the invention and the third aspect of the invention, and vice versa.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the context clearly dictates otherwise.

The words "preferred" and "preferably" refer to embodiments of the invention that may afford certain benefits, under certain circumstances. Particularly preferred are aerosol-generating systems according to the invention comprising combinations of preferred features. For example, where aerosol-generating systems according to the invention comprise an aerosol-generating article and an aerosol-generating device in cooperation with the aerosol-generating article, particularly preferred are embodiments comprising a combination of a preferred aerosol-generating article and a preferred aerosol-generating device.

However, it will be appreciated that other embodiments may also be preferred, under the same or other circumstances. Furthermore, the recitation of one or more preferred embodiments does not imply that other embodiments are not useful, and is not intended to exclude other embodiments from the scope of the disclosure and claims.

The invention will now be further described with reference to the accompanying drawing in which:

FIG. 1 shows a schematic longitudinal cross-section of an aerosol-generating system according to an embodiment of the invention.

FIG. 1 schematically shows an aerosol-generating system according to an embodiment of the invention comprising an aerosol-generating article 2 and an aerosol-generating device 4.

The aerosol-generating article 2 has an elongate cylindrical housing comprising a first compartment 6 comprising a nicotine source, a heat transfer barrier 8, a second compartment 10 comprising a volatile delivery enhancing compound source, a third compartment 12 and a mouthpiece 14. As shown in FIG. 1, the first compartment 6, the heat transfer barrier 8, the second compartment 10, the third compartment 12 and the mouthpiece 14 are arranged in series and in coaxial alignment within the aerosol-generating article 2. The first compartment 6 is located at the distal end of the aerosol-generating article 2. The second compartment 10 is located downstream of the first compartment 6. The heat transfer barrier 8 is located between the first compartment 6 and the second compartment 10. The third compartment 12 is located immediately downstream of the second compartment 10. The mouthpiece 14 is located immediately downstream of the third compartment 10 at the proximal end of the aerosol-generating article 2.

The upstream and downstream ends of the first compartment 6 and the second compartment 10 of the aerosol-generating article 2 are sealed by frangible aluminium foil barriers (not shown).

The aerosol-generating device 4 comprises a housing comprising an elongate cylindrical cavity in which the aerosol-generating article 2 is received. The length of the cavity is less than the length of the aerosol-generating article 2 so that the proximal end of the aerosol-generating article 2 protrudes from the cavity.

The aerosol-generating device 4 further comprises a power supply 16, a controller (not shown), heating means 18, and a piercing element 20. The power supply 16 is a battery and the controller comprises electronic circuitry and is connected to the power supply 16 and the heating means 18.

The heating means 18 comprises an external heating element positioned about the perimeter of a portion of the cavity at the distal end thereof and extends fully around the circumference of the cavity. As shown in FIG. 1, the external heating element is positioned so that it circumscribes the first compartment 6 and an upstream portion of the heat transfer barrier 8 of the aerosol-generating article 2.

The piercing element 20 is positioned centrally within the cavity of the aerosol-generating device 4 and extends along the major axis of the cavity.

In use, as the aerosol-generating article 2 is inserted into the cavity of the aerosol-generating device 4 the piercing element 20 is inserted into the aerosol-generating article 2 and pierces the frangible barriers (not shown) at the upstream and downstream ends of the first compartment 6 and the second compartment 10 of the aerosol-generating article 2. This allows a user to draw air into the housing of the aerosol-generating article through the distal end thereof, downstream through the first compartment 6, the heat transfer barrier 8, the second compartment 10 and the third compartment 12 and out of the housing through the mouthpiece 14 at the proximal end thereof.

Nicotine vapour is released from the nicotine source in the first compartment 6 into the air stream drawn through the aerosol-generating article 2 and volatile delivery enhancing compound vapour is released from the volatile delivery enhancing compound source in the second compartment 10 into the air stream drawn through the aerosol-generating article 2. The nicotine vapour reacts with the volatile delivery enhancing compound vapour in the gas phase in the second compartment 10 and the third compartment 12 to form an aerosol, which is delivered to the user through the mouthpiece 14 at the proximal end of the aerosol-generating article 2.

In use, the heat transfer barrier 10 reduces heat transfer from the first compartment 6 to the second compartment 10 as the first compartment is heated by the heating means 18 so that the second compartment 10 of the aerosol-generating article 2 is maintained at a lower temperature than the first compartment 6.

The first compartment 6 of the aerosol-generating article 2 comprises a nicotine source comprising a porous sorption element with 10 mg of nicotine sorbed thereon, the heat transfer barrier 8 of the aerosol-generating article 2 comprises an air-filled cavity, and the second compartment 10 of the aerosol-generating article 2 comprises a pyruvic acid source comprising a porous sorption element with 20 mg of pyruvic acid sorbed thereon. The first compartment 6, the heat transfer barrier 8 and the second compartment 10 of the aerosol-generating article 2 are each about 10 mm in length. The third compartment 12 of the aerosol-generating article 2 is about 25 mm in length. The mouthpiece 14 of the aerosol-generating article 2 is about 10 mm in length. The total length of the aerosol-generating article 2 is about 85 mm.

The external heating element of the heating means 18 of the aerosol-generating device 4 is about 15 mm in length. The heating means 18 is configured to heat the first compartment 6 to a temperature of less than about 110° C. In use a constant power supply is provided to the heating means 18 so as to heat the exterior of the first compartment 6 to a temperature of between about 100° C. and about 110° C. over a period of about 150 seconds and to then maintain the temperature within this range for a period of at least 200 seconds.

Due to inclusion of the heat transfer barrier 8, the second compartment 10 of the aerosol-generating article 2 is maintained at a temperature of less than about 45° C. during heating of the first compartment 6 by the heating means 18. To demonstrate this, temperature measurements are taken using first and second temperature sensors during heating of the first compartment 6 by the heating means 18 over a period of 6 minutes starting upon initiation of the heating means 18. The first and second temperature sensors are attached to the exterior of the first and second compartments, respectively, approximately half-way along the length thereof. The results are shown in Table 1.

TABLE 1

| Time (seconds) | Temperature of first compartment (° C.) | Temperature of second compartment (° C.) |
|---|---|---|
| 0 | 26 | 25 |
| 30 | 65 | 25 |
| 60 | 82 | 27 |
| 90 | 92 | 30 |
| 120 | 98 | 33 |
| 150 | 101 | 35 |
| 180 | 103 | 37 |
| 210 | 105 | 38 |
| 240 | 106 | 39 |
| 270 | 106 | 40 |
| 300 | 107 | 41 |
| 330 | 107 | 42 |
| 360 | 107 | 43 |

The average nicotine delivery (μg/puff) of the aerosol-generating system according to the embodiment of the invention shown in FIG. 1 is measured as a function of puff number during operation of the aerosol-generating system according to a Health Canada Intense smoking regime (55 $cm^3$ puff volume, 30 second puff frequency, 2 second puff duration and 100% vent blocking).

For the purpose of comparison, the average nicotine delivery (μg/puff) of a reference aerosol-generating system not according to the invention as a function of puff number during operation of the aerosol-generating system according to a Health Canada Intense smoking regime (55 $cm^3$ puff volume, 30 second puff frequency, 2 second puff duration and 100% vent blocking) is also measured. The reference aerosol-generating system differs from the aerosol-generating article according to FIG. 1 in that the position of the pyruvic acid source and the nicotine source are reversed such that the first compartment comprises the pyruvic acid source and the second compartment comprises the nicotine source. The aerosol-generating article of the reference aerosol-generating system thus comprises a first compartment comprising a pyruvic acid source comprising a porous sorption element with 20 mg of pyruvic acid sorbed thereon and a second compartment comprising a nicotine source comprising a porous sorption element with 10 mg of nicotine sorbed thereon.

The average nicotine delivery (μg/puff) of the aerosol-generating system according to the invention, which comprises an aerosol-generating article comprising a nicotine source, a volatile delivery enhancing compound source downstream of the nicotine source and a heat transfer barrier between the nicotine source and the volatile delivery enhancing compound source, increases with increasing puff number. The increasing puff per puff nicotine delivery of the aerosol-generating system according to the invention is similar to the increasing puff per puff nicotine delivery of conventional lit-end cigarettes.

The average nicotine delivery (μg/puff) of the reference aerosol-generating system, which comprises an aerosol-generating article comprising a nicotine source and a volatile delivery enhancing compound immediately upstream of the nicotine source, is significantly lower than the nicotine delivery of the aerosol-generating system according to the invention. Furthermore, in contrast to the aerosol-generating system according to the invention and conventional lit-end cigarettes, the average nicotine delivery (μg/puff) of the reference aerosol-generating system decreases with increasing puff number.

The invention claimed is:

1. An aerosol-generating system, comprising:

a nicotine source;

a volatile delivery enhancing compound source downstream of the nicotine source, wherein a volatile delivery enhancing compound of the volatile delivery enhancing compound source comprises an acid;

heating means configured to heat the nicotine source to a temperature of between about 80° C. and about 150° C.; and a physically separate heat transfer barrier between the nicotine source and the volatile delivery enhancing compound source, wherein the physically separate heat transfer barrier is configured so that the temperature of the volatile delivery enhancing compound source is below about 60° C. when the nicotine source is heated to a temperature of between about 80° C. and about 150° C. by the heating means.

2. The aerosol-generating system according to claim 1, wherein the physically separate heat transfer barrier comprises a solid material or a gas, a vacuum or a partial vacuum, or a combination thereof.

3. The aerosol-generating system according to claim 1, wherein the physically separate heat transfer barrier comprises a solid material having a thermal conductivity of less than about 1 W per meter Kelvin (W/(m·K)) at 23° C. and a relative humidity of 50%.

4. The aerosol-generating system according to claim 2, wherein the physically separate heat transfer barrier further comprises a cavity having a length of at least about 8 mm.

5. The aerosol-generating system according to claim 1, wherein the nicotine source comprises a first sorption element and nicotine sorbed on the first sorption element.

6. The aerosol-generating system according to claim 5, wherein the volatile delivery enhancing compound source comprises a second sorption element and the volatile delivery enhancing compound sorbed on the second sorption element.

7. The aerosol-generating system according to claim 1, wherein the volatile delivery enhancing compound acid comprises a carboxylic acid.

8. The aerosol-generating system according to claim 1, wherein the acid is selected from the group consisting of 3-methyl-2-oxovaleric acid, pyruvic acid, 2-oxovaleric acid, 4-methyl-2-oxovaleric acid, 3-methyl-2-oxobutanoic acid, 2-oxooctanoic acid, lactic acid, and combinations thereof.

9. The aerosol-generating system according to claim 1, wherein the acid is pyruvic acid or lactic acid.

10. The aerosol-generating system according to claim 1, further comprising a housing comprising an air inlet and an air outlet, the housing further comprising in series from air inlet to air outlet:

a first compartment comprising the nicotine source in communication with the air inlet;

a second compartment comprising the volatile delivery enhancing compound source in communication with the first compartment; and the physically separate heat transfer barrier disposed between the first compartment and the second compartment, wherein the air inlet and the air outlet are in communication with each other and are configured so that air may pass into the housing through the air inlet, through the housing, and out of the housing through the air outlet.

11. The aerosol-generating system according to claim 10, wherein one or both of the first compartment and the second compartment are sealed by one or more frangible barriers.

12. The aerosol-generating system according to claim 11, further comprising a piercing element configured to pierce the one or more frangible barriers sealing one or both of the first compartment and the second compartment.

13. The aerosol-generating system according to claim 1, further comprising:

an aerosol-generating article comprising the nicotine source, the volatile delivery enhancing compound source, and the physically separate heat transfer barrier.

14. The aerosol-generating system according to claim 13, further comprising:

an aerosol-generating device in cooperation with the aerosol-generating article, the aerosol generating device comprising the heating means configured to heat the nicotine source of the aerosol-generating article.

* * * * *